United States Patent [19]

Durfee, Jr.

[11] Patent Number: 4,923,186

[45] Date of Patent: May 8, 1990

[54] QUICK LOCK IN PARALLEL AND ANGLE PLATE SYSTEM FOR MACHINING VISE

[75] Inventor: David L. Durfee, Jr., Erie, Pa.

[73] Assignee: Susan M. Durfee, Meadville, Pa.

[21] Appl. No.: 223,428

[22] Filed: Jul. 25, 1988

Related U.S. Application Data

[63] Continuation-in-part of Ser. No. 941,717, Dec. 15, 1986, abandoned.

[51] Int. Cl.[5] ..... B25B 1/24

[52] U.S. Cl. ..... 269/282; 269/271; 269/280

[58] Field of Search ..... 269/271, 279, 280, 281, 269/282, 283, 284, 275, 261, 262

[56] References Cited

U.S. PATENT DOCUMENTS

| | | | |
|---|---|---|---|
| 81,764 | 9/1868 | Fisher | 269/261 |
| 92,331 | 7/1869 | Mason | 269/261 |
| 234,930 | 11/1880 | Stephens | 269/262 |
| 1,212,123 | 5/1916 | Anderson | 269/256 |
| 1,579,582 | 4/1926 | Voltz | 269/283 |
| 2,284,449 | 8/1939 | Rodess | 269/261 |
| 2,392,310 | 1/1946 | Chrestoff | 269/262 |
| 2,880,638 | 4/1959 | Muggli | 269/262 |
| 3,186,706 | 6/1965 | DeFelice | 269/136 |
| 3,368,808 | 2/1968 | Worthington | 269/279 |
| 3,685,817 | 8/1972 | Worthington | 269/139 |
| 4,019,726 | 4/1977 | Turner | 269/261 |
| 4,251,066 | 2/1981 | Bowling | 269/283 |
| 4,482,306 | 4/1986 | Sassenberg | 269/282 |

*Primary Examiner*—Judy Hartman

*Attorney, Agent, or Firm*—Wayne L. Lovercheck; Charles L. Lovercheck; Dale R. Lovercheck

[57] ABSTRACT

A holding device or lock in a machining vise for positioning plates including parallels and angles wherein the positioning plate is provided with a cleat extending from the rear surface along the bottom edge thereof. The plates are held in place by spring loaded engaging members. A recess in the machining vise, complementary in shape to the cleat, may be provided.

14 Claims, 2 Drawing Sheets

QUICK LOCK IN PARALLEL AND ANGLE PLATE SYSTEM FOR MACHINING VISE

CROSS REFEREMCE TO PRIOR APPLICATION

This application is a continuation-in-part of my copending U.S. patent application Ser. No. 941,747, filed Dec. 15, 1986, abandoned.

SHORT STATEMENT OF THE INVENTION

Parallels and angle plates used in machine vises are traditionally held in place by springs which are inconvenient to use and which become separated from the vise. Also, chips tend to work their way between the vise and the parallels or angle plates and the accuracy of the positioning of the workpiece in the vise is therefore disturbed. The particular parallel and angle plates disclosed herein are made of a single plate with parallel or angled surfaces and a cleat rearwardly extending from the plate at its bottom which may be received in a complementary shaped slot in the removable jaw of the vise. The plates are held in place by spring loaded detent pins.

BACKGROUND OF THE INVENTION

This invention relates to an improved lock in parallel and angle mechanism that permits the quick attachment and detachment of the parallel or angle mechanism.

There is a long felt need for a simple efficient and economical locking or holding device for holding parallels and angles securely in machine vises. The parallel and angle system according to the present invention includes a cleat that is received in a slot in a removable jaw of the machine vise. Spring loaded detents hold the cleat in place in a complementary shaped slot in the removable jaw of the vise.

It is an object of the invention to provide improved parallels and angle plates for use on a machine vise.

Another object of the invention is to provide a parallel and angle plate for a machine vise and means to hold the jaw in place which is simple in construction, economical to manufacture and simple and efficient to use. This will in turn make it more economical to make and accurate to perform machining operations on parts being held in the machine vise.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
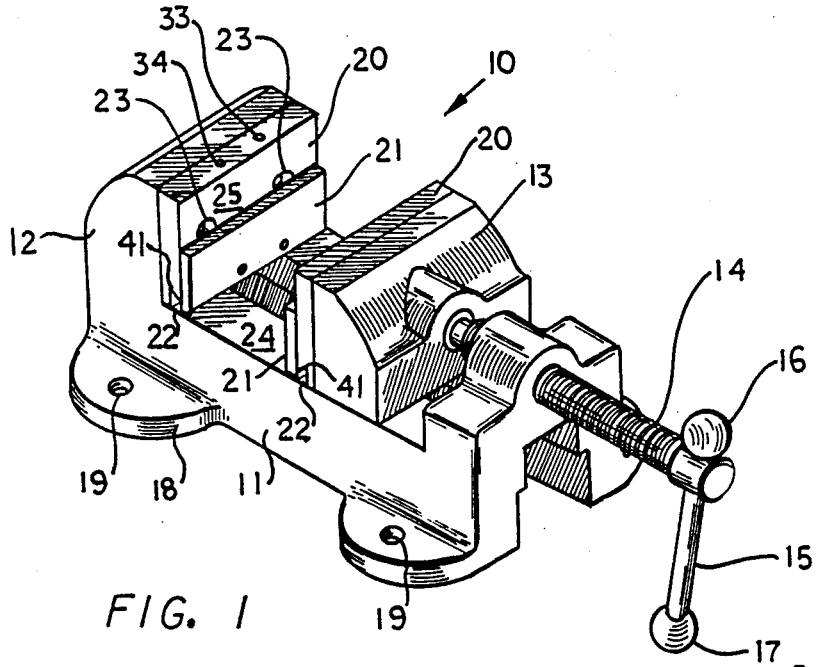
FIG. 1 is an isometric view of a machine vise with a parallel system supported on it according to the invention.

Now with more particular reference to the drawing, I show a machine vise 10 of conventional construction in FIG. 1 equipped with my improved jaw. The machine vise 10 has a base 11, a fixed jaw 12 fixed to base 11 and a movable jaw 13 slidably supported on base 1 and having a screw 14 threadably received in base 12 and engaging movable jaw 13 for moving it toward and away from fixed jaw 12. Base 11 has ears 18 integrally attached to it and extending outwardly from it. Ears 18 have bores 19 that receive screws for holding vise 10 to a milling machine table or the like. Handle 15 extends through screw 14 and has knobs 16 and 17 on its ends for rotating the screw and moving the movable jaw 13.

Removably jaw plates 20 are held to fixed jaw 11 and to movable jaw 13 in a conventional manner by means of screws 23 shown. Parallel plate 21 are held to fixed jaw 12 and to movable jaw 13 respectively by means of cleats 22, which are received in complementary shaped slots 41 at the lower edge of removable jaws 20. The top surface 24 of base 11 is flat. The bottom surface of movable jaw 13, as well as the bottom surface of parallel jaw 21, and cleat 22 slide over top surface 24 when the screw 14 is rotated by the handle 15.

Figure 3:
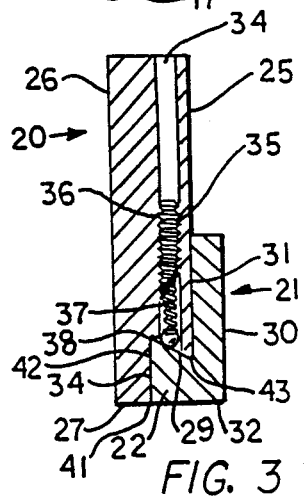
FIG. 3 is a longitudinal cross sectional view of the vise of FIG. 1.

As shown in FIG. 3, removable jaw plates 20 are in the form of rectangular shaped plates with a parallel front surface 25 which is parallel to rear surface 26 and both surfaces 25 and 26 are perpendicular to bottom surface 27. The slot 41 in the front surface 25 has a back surface 42 and a top surface 43 that inclines upwardly and toward back surface 42. Parallel jaw 21 has front surface 30 and rear surface 31 parallel to it which are both perpendicular to bottom surface 32. Cleat 22 has a flat bottom surface that is a continuation of bottom surface 32 of the parallel plate 21, a rear surface 28 and a top surface 29 that inclines downwardly and toward rear surface 31. Each cleat 22 is complementary in shape to the corresponding slot 41 in the lower edge of each removable jaw 20. Removable jaw 20 has two spaced bores 33 and 34 which are threaded at 35 and receive a threaded screw 36 that engages spring 37 and urges detent member 38 into engagement with the top surface 29 of cleat 22. Detent member 38 may be in the shape of a ball, as shown in the drawing, or it may be made in other configurations adapted to engage cleat 22. The tension on spring 37 may be increased by adjusting threaded screw 36.

Figure 4:
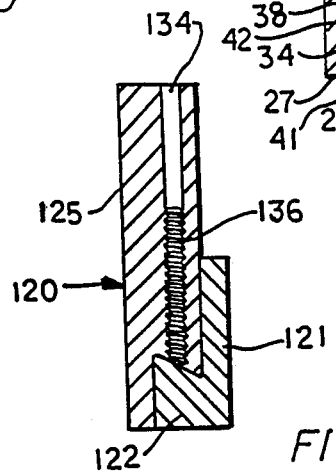
FIG. 4 is a cross sectional view similar to FIG. 3 showing a cross sectional view of the vise with a different parallel holding device thereon.

The embodiment of the invention shown in FIG. 4 is similar to the one shown in FIG. 3, excepting parallel plate 121 has a cleat 122 on its lower end which is engaged by screws 136 themselves instead of a detent ball and the screws 136 are received in threaded bores 134 in removable jaw 120.

Figure 5:
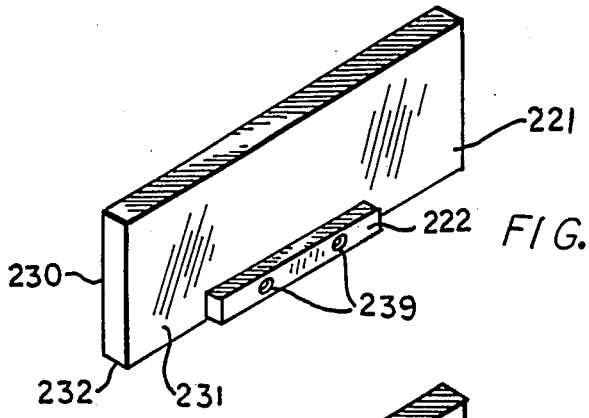
FIG. 5 is an isometric view of another embodiment of the parallel for a machine vise.

Parallel plate 221 shown in FIG. 5 has a front surface 230, a rear surface 231 and a bottom surface 232 and is similar in shape and configuration to parallel plate 21 shown in FIG. 3. However, cleat 222 is removable and threadably attached to parallel plates 221 by means of screws 239 which clamp cleat 222 to parallel plate 221. Cleat 222 will fit in a groove 41 of complementary shape in removable jaw plate 20 and is held in place by screws such as 33 and 34 as shown in the embodiment of FIG. 1.

Figure 2:
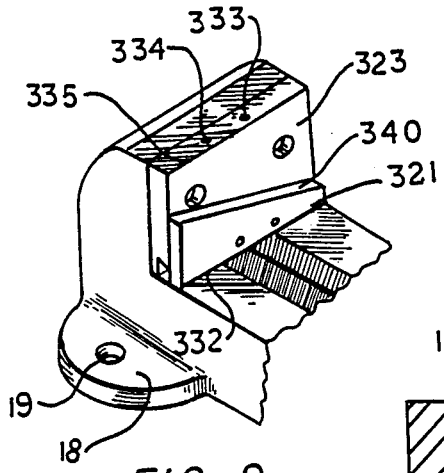
FIG. 2 is a partial view of the vise and parallel system shown in FIG. 1 with a parallel having an inclined top according to the invention.

Angle plate 321 shown in the embodiment of the invention shown in FIG. 2 may have a cleat shaped like any of those shown in the embodiment of FIGS. 1 and 3 through 7 but its upper edge 340 is inclined relative to the bottom surface 332 of angle plate 321, thus allowing a piece being held in vise to be supported at a predetermined position. Depending on the angle desired, several angle plates with various top surface angles may be provided.

Figure 6:
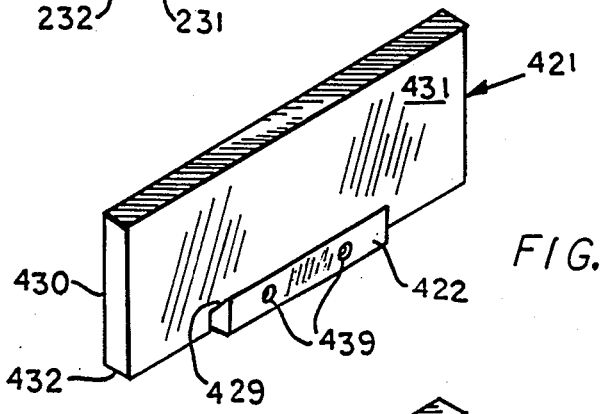
FIG. 6 is an isometric view of another form of cleat removably supported on the jaw; and, FIG. 7 is an isometric view of yet another form of the parallel cleat.

The embodiment of the invention shown in FIG. 6 has a cleat 422 fixed to the rear surface 431 of parallel plate 421. Parallel plate 421 has a front surface 430 and a bottom surface 432 similar to the other embodiments. The cleat 422 is attached to the parallel plate by screws 439 and has an inclined upper surface 429 similar to the top surface 29 shown in FIG. 3.

Figure 7:
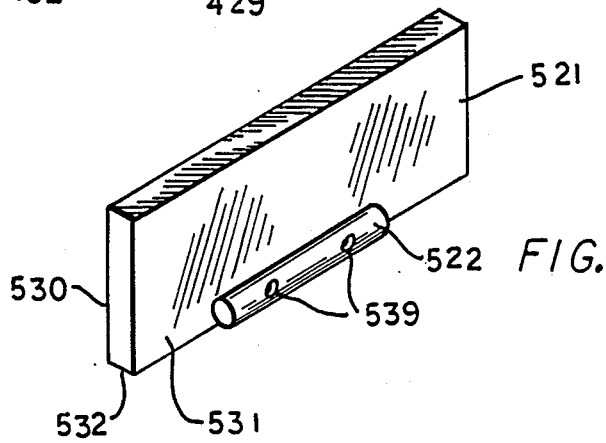

In the embodiment of the invention shown in FIG. 7, parallel plate 521 has a front surface 530, a rear surface 531, a bottom surface 532 and a cylindrical shaped cleat 522 held in place by screws 539. The removably jaw of the milling machine vise will have a slot at its bottom complementary in shape to cylindrical cleat 522. It may be shorter than the width of parallel plate 521.

Cleats may be attached to the parallel plates by screws or other means but also can be of one unit such as being cast complete as one unit or being machined out of one piece of metal as a complete unit as shown in FIG. 3.

The foregoing specification set forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A machinist vise comprising, a base having a reference surface and a fixed jaw attached to said base and extending upwardly therefrom, a movable jaw supported on said base, a first removable jaw attached to said fixed jaw and having a downwardly facing surface and a front surface, a second removable jaw attached to said movable jaw and having a downwardly facing surface and a front surface, a first positioning plate having a top surface and a bottom surface, and a recess in said bottom surface said bottom surface of said first positioning plate resting on said reference surface, a second positioning plate having a top surface and a bottom surface, and a recess in said bottom surface said bottom surface of said second positioning plate resting on said reference surface, a first cleat attached to said first positioning plate adjacent said bottom surface of said first positioning plate, a second cleat attached to said second positioning plate adjacent said bottom surface of said second positioning plate, a first engagement means on said first removable jaw engaging said first cleat within said first recess forcing said bottom surface of said first positioning plate into engagement with said reference surface, a second engagement means on said second removable jaw engaging said second cleat within said second recess forcing said bottom surface of said second positioning plate into engagement with said reference surface whereby said positioning plates may be pushed into an operative location such that said first engagement means and said second engagement means holds said cleats and said bottom surfaces of said positioning plates in place against said reference surface without movement of said positioning plates.

2. The machining vise recited in claim 1 wherein each of said cleats are square in cross section.

3. The machining vise recited in claim 1 wherein each of said cleats are in the form of a part of a cylindrical surface.

4. The machining vise recited in claim 1, wherein each of said top surfaces are parallel to said respective bottom surface.

5. The machinery vise recited in claim 1 wherein each of said top surface are inclined at an acute angle to said respective bottom surfaces.

6. The combination recited in claim 1 wherein said recesses are generally complementary in shape to said cleats and extending along at least a portion of the length of said removable jaws and extending from a point in said bottom sides generally downwardly and outwardly to a point in said front sides.

7. The combination recited in claim 2 wherein said recesses are generally complementary in shape to said cleats and extending along at least a portion of the length of said removable jaws and extend from a point in said bottom sides generally downwardly and outwardly to a point in said front sides.

8. In combination, a machinists vise having a base, a fixed jaw, a movable jaw, a first removable jaw attached to said fixed jaw, a second removable jaw attached to said movable jaw, a first positioning plate and a second positioning plate, said first removable jaw and said second removable jaw each being generally rectangular in cross section and having top, bottom, front and rear surfaces, said first positioning plate and said second positioning plate each being generally rectangular in cross section and having top, bottom, front, and rear surfaces, said base having a generally flat upwardly facing reference surface, said bottom surface of said positioning plates resting on said upwardly facing reference surface of said base, a first cleat fixed to said first positioning plate adjacent said bottom surface thereof, a second cleat fixed to said second positioning plate adjacent said bottom surface thereof, a first recess formed in said bottom surface of said first removable jaw and defined by a recess surface terminating in said front surface of said first removable jaw, said first recess being complementary in shape to said first cleat whereby said first recess receives said first cleat, a second recess formed in said bottom surface of said second removable jaw and defined by a recess surface terminating in said front surface of said second removable jaw, said second recess being complementary in shape to said second cleat whereby said second recess receives said second cleat, a first hole in said first removable jaw and a second hole in said second removable jaw, said holes extending from said top surfaces of said removable jaws to said recess surfaces, threaded members received in said holes and engaging means on said threaded members engaging said cleats whereby said cleats are clamped between said removable jaws and said flat upwardly facing reference surface of said base wherein said means for engaging said cleats comprises said threaded members being adapted to hold said positioning plates in position and said first and said second positioning plates are prevented from creeping longitudinally or upwardly along said front surfaces of said first and said second removable jaws when a work piece is clamped between said first and said second removable jaws of said machining vise, whereby said positioning plate may be pushed into an operative location such that said threaded members hold said cleat and said bottom side of said positioning plate in place against said reference surface without movement of said positioning plate.

9. The machining vise recited in claim 8 wherein each of said cleats are a top inclined surface inclined to said bottom surface at an acute angle.

10. The machining vise recited in claim 8 wherein each of said cleats are fixed to said machining vise and terminate at a position spaced from the ends thereof.

11. The machining vise recited in claim 8 wherein each of said cleats are square in cross section.

12. The machining vise recited in claim 8 wherein each of said cleats are cylindrical in cross section.

13. The machining vise recited in claim 8 wherein each of said top surface are parallel to said respective bottom surface.

14. The machining vise recited in claim 8 wherein each of said top surfaces are inclined at an acute angle to said respective bottom surface.

* * * * *

UNITED STATES PATENT AND TRADEMARK OFFICE

CERTIFICATE OF CORRECTION

PATENT NO. : 4,923,186

DATED : May 8, 1990

INVENTOR(S) : David L. Durfee, Jr.

It is certified that error appears in the above-identified patent and that said Letters Patent is hereby corrected as shown below:

Claim 1, line 8, (Column 3, line 54), after "surface" insert --and a recess in said downwardly facing surface--;

Claim 1, line 11, (Column 3, line 57), after "surface" insert --and a recess in said downwardly facing surface--;

Claim 1, line 13, (Column 3, line 59), delete "and a recess in said bottom surface";

Claim 1, line 17, (Column 3, line 63), delete "and a recess in said bottom surface".

UNITED STATES PATENT AND TRADEMARK OFFICE

CERTIFICATE OF CORRECTION

PATENT NO. : 4,923,186

DATED : May 8, 1990

INVENTOR(S) : David L. Durfee, Jr.

It is certified that error appears in the above-identified patent and that said Letters Patent is hereby corrected as shown below:

Claim 7, lines 1-6 ( Column 4, lines 36-41), delete in their entirety, and substitute the following:

--7. The machining vise recited in claim 1, wherein each of said cleats have an upper surface inclined to said bottom surface of said respective positioning plates at an acute angle--.

Signed and Sealed this

Eleventh Day of August, 1992

*Attest:*

DOUGLAS B. COMER

*Attesting Officer*

*Acting Commissioner of Patents and Trademarks*